US006109027A

United States Patent [19]

Schaefer

[11] Patent Number: 6,109,027

[45] Date of Patent: Aug. 29, 2000

[54] EXHAUST RESTRICTION DEVICE

[75] Inventor: Norman Schaefer, Riverton, Conn.

[73] Assignee: Diesel Engine Retarders, Inc., Christiana, Del.

[21] Appl. No.: 09/250,608

[22] Filed: Feb. 17, 1999

Related U.S. Application Data

[60] Provisional application No. 60/074,927, Feb. 17, 1998.

[51] Int. Cl.[7] ..... F01N 7/00

[52] U.S. Cl. ..... 60/324; 60/287; 60/291; 123/323; 137/115.26; 137/494

[58] Field of Search ..... 60/324, 287, 291, 60/292, 293; 123/323; 137/115.26, 115.13, 494

[56] References Cited

U.S. PATENT DOCUMENTS

| | | | |
|---|---|---|---|
| 2,895,571 | 7/1959 | Hanebeck . | |
| 3,096,614 | 7/1963 | Silver et al. . | |
| 3,234,924 | 2/1966 | May . | |
| 3,523,418 | 8/1970 | Marsee . | |
| 3,591,959 | 7/1971 | Kubis . | |
| 3,838,670 | 10/1974 | King . | |
| 3,941,035 | 3/1976 | Mueller . | |
| 4,005,578 | 2/1977 | McInerney . | |
| 4,005,579 | 2/1977 | Lloyd . | |
| 4,062,332 | 12/1977 | Perr . | |
| 4,075,990 | 2/1978 | Ribeton . | |
| 4,220,008 | 9/1980 | Wilber et al. . | |
| 4,335,849 | 6/1982 | van Bashuysen . | |
| 4,387,572 | 6/1983 | Richardson et al. . | |
| 4,389,984 | 6/1983 | Destrampe . | |
| 4,553,648 | 11/1985 | Suzuki et al. . | |
| 4,557,223 | 12/1985 | Joppig et al. . | |
| 4,665,692 | 5/1987 | Inaba . | |
| 4,669,435 | 6/1987 | Furusawa et al. . | |
| 4,682,674 | 7/1987 | Schmidt . | |
| 4,707,987 | 11/1987 | Atkin . | |
| 4,750,459 | 6/1988 | Schmidt | 123/323 |
| 4,787,044 | 11/1988 | Nagata et al. . | |
| 4,835,963 | 6/1989 | Hardy . | |
| 4,905,200 | 2/1990 | Pidsosny et al. . | |
| 4,945,870 | 8/1990 | Richeson . | |
| 4,987,869 | 1/1991 | Hilburger . | |
| 5,050,376 | 9/1991 | Stiglic et al. . | |
| 5,079,921 | 1/1992 | McCandless et al. . | |
| 5,372,109 | 12/1994 | Thompson et al. . | |
| 5,435,347 | 7/1995 | Gillingham . | |
| 5,638,926 | 6/1997 | McCrickard . | |
| 5,675,969 | 10/1997 | Satoh | 60/324 |

FOREIGN PATENT DOCUMENTS

| | | |
|---|---|---|
| 40 40 760 A1 | 6/1991 | Germany . |
| 59-158364 | 7/1984 | Japan . |
| 2181182 | 4/1987 | United Kingdom . |

OTHER PUBLICATIONS

Hakansson, N., Kemlin, J. and Nilsson, R., "Cold Starting the Volvo Way", SAE/P–89–220, 1989.

Buntling, A., "Eager for EGR", Transport Engineer, Jul. 1997.

*Primary Examiner*—Thomas Denion
*Assistant Examiner*—Binh Tran
*Attorney, Agent, or Firm*—David R. Yohannan; Collier Shannon Scott, PLLC

[57] ABSTRACT

An exhaust restriction device for an internal combustion engine is disclosed. The exhaust restriction device includes a main valve and a bypass valve for restricting the flow of exhaust gas. The main valve is located in a main passage and may be selectively closed. The bypass valve is located in a bypass passage and is biased into a position closing a port connecting the main passage and the bypass passage. Closing the main valve may cause exhaust back pressure to build against the bypass valve and an actuator therefor until the biasing force is overcome. When the biasing force is surpassed by the exhaust back pressure, the bypass valve opens to relieve the back pressure. The bypass valve closes when back pressure falls below the biasing force. A method of operating the exhaust restriction device is also disclosed.

17 Claims, 3 Drawing Sheets

EXHAUST RESTRICTION DEVICE

CROSS-RELATED PATENT APPLICATION

This application relates to and claims priority on application Ser. No. 60/074,927 filed on Feb. 17, 1998 and entitled "Exhaust Restriction Device".

FIELD OF THE INVENTION

The present invention relates to devices used to restrict exhaust gas flow through an internal combustion engine. More specifically, the invention relates to control of the flow of exhaust gas through an engine in order to accelerate warm-up of the engine.

BACKGROUND OF THE INVENTION

Presently, it is not uncommon for vehicles, such as trucks and buses, to be equipped with an exhaust restriction device. Such devices may be used for exhaust braking or for engine warm-up. Fundamentally, an exhaust restriction device need only comprise some means for restricting the flow of exhaust gas from an internal combustion engine. Restricting the exhaust gas increases the exhaust manifold pressure, i.e. "back pressure." The exhaust manifold pressure may be used to oppose the motion of the engine pistons for engine retarding or for warm up by increasing fueling rates and heat rejection. Thus, the engine and vehicle may be slowed and/or heated in relation to exhaust manifold pressure. Selective restriction of the flow of exhaust gas from the engine may therefore be used to selectively brake or warm up a vehicle.

Exhaust manifold pressure produced by an exhaust restriction device may be particularly useful in warming an engine during positive power operation. A cold engine may be more quickly warmed by placing the engine under load during positive power operation. Closing an exhaust restriction device during positive power creates an engine load because it makes it more difficult for the pistons to cycle in the cylinders. The exhaust restriction device creates this load by backing up warm exhaust gases in the engine and exhaust manifold which causes the engine to increase fuel consumption and increase heat rejection. Placing the engine under load increases the rate of raising vehicle cab temperature and decreases warm up time. Placing the engine under load by increasing exhaust manifold pressure is also desirable because it raises exhaust temperature, which promotes combustion and decreases carbon build up. Decreases in carbon help to alleviate emissions concerns, as well as problems with engine valve sticking.

One device for producing exhaust back pressure using a butterfly valve to restrict exhaust flow from a turbo charger outlet is disclosed in U.S. Pat. No. 5,079,921 to McCandless et al. In the device disclosed in this patent, the control of exhaust pressure results solely from opening and closing a butterfly valve adjacent to an engine turbocharger.

A device for producing a desired level of intake manifold pressure, as opposed to exhaust manifold pressure, is disclosed in U.S. Pat. No. 4,005,578 to McInerney. This device is also for use in conjunction with a turbocharger. The turbo compressor output is regulated by control of exhaust flow through the turbo turbine. This device does not control exhaust flow in response to the pressure in the exhaust system.

Devices for modulating exhaust flow are disclosed in U.S. Pat. No. 5,372,109 to Thompson et al. One of the disclosed devices includes a plunger to cover a bleed flow path. The plunger is controlled by computer controlled application of air or hydraulic fluid to the plunger. The plunger is not controlled by the application of exhaust gas to any actuation means. Another of the disclosed devices in Thompson includes a reed valve to cover a bleed flow path. The amount of deflection of the reed valve is the direct result of the application of exhaust pressure through the bleed flow path to the reed valve.

Some other exhaust restriction devices have been designed to provide a fixed maximum level of back pressure over a range of engine speeds. In such exhaust devices, control of the exhaust manifold pressure may be achieved by control of the restriction of exhaust gas flow by the device. These exhaust restriction devices may typically allow back pressure to build to a preset limit. Back pressure which exceeds the preset limit is relieved via a bypass around the closed exhaust restriction device. For example, U.S. Pat. No. 5,638,926 to McCrickard discloses an exhaust brake having a main tube and a bypass tube. During exhaust braking, the main tube is blocked with a rotatable valve. Back pressure is relieved by opening a bypass valve located at the downstream end of the bypass tube. Also see U.S. Pat. Nos. 4,750,459 and 4,682,674 to Schmidt, and U.S. Pat. No. 5,372,109 to Thompson et al., which disclose alternative bypass arrangements for an exhaust restriction device.

One impediment to the operation of known exhaust restriction devices is that they may expose the bypass valve, including its actuation means, to harsh temperatures and pollutants.

Bypass systems, preferably, should be constructed to remain operable under the harsh conditions experienced within an exhaust restriction device or removed from such harsh conditions. Exhaust gas typically contains carbon particles, water moisture, and other contaminants within it. Exposure of the moving parts of a bypass system to exhaust gas and its contaminants can cause the moving parts to corrode/oxidize and become coked/coated with carbon. Bypass valves, such as the one disclosed in the above-referenced McCrickard, Schmidt, and Thompson et al. patents, may become inoperable because of the build up of contaminants on the moving parts in the system. Accordingly, there is a need for an exhaust bypass system that is less prone to malfunction as a result of carbon, rust, or other contaminant build up on the moving parts of the bypass.

Furthermore, bypass systems should preferably be designed to avoid the exposure of heat sensitive elements of the bypass from being over exposed to high temperature exhaust gas. A bypass system may use a spring and/or electronic activators to open and close the bypass. These types of elements may not operate well under the fluctuating or extreme temperature conditions experienced within an exhaust restriction device. Accordingly, there is a need for an exhaust restriction device with a bypass actuator that is sufficiently thermally isolated and/or that has an acceptable tolerance of high temperature exhaust gas.

One of the designs described herein is a bolt-on bypass circuit which may be very effective at reducing the exposure of the bypass spring and/or electronic activators to exhaust gas temperatures. A bolt-on bypass may also add the benefit of flexible manufacturability which allows for a fixed flow area device or a variable area device with minimal manufacturing set up changes. A bolt-on bypass may be used with an exhaust restriction device that is pre-configured to accept the bypass. The exhaust restriction device may be provided originally with two or more plugged ports. The ports may be unplugged when a bolt-on bypass is added to provide exhaust gas flow to and from the bypass.

Another advantage of the exhaust restriction designs described herein, is the suitability of the designs to provide both an exhaust brake and a warm up device.

OBJECTS OF THE INVENTION

It is therefore an object of the present invention to provide an exhaust restriction device that may serve as both an exhaust brake and a warm up device.

It is another object of the present invention to provide an exhaust restriction device with a bypass around a main valve in the exhaust restriction device.

It is a further object of the present invention to provide selective activation of a bypass valve in an exhaust restriction device.

It is still another object of the present invention to isolate a means for operating a bypass valve in an exhaust restriction device from exhaust gas born contaminants.

It is still another object of the present invention to isolate a means for operating a bypass valve in an exhaust restriction device from high temperature exhaust gas.

It is yet another object of the present invention to provide selective activation of a bypass valve in an exhaust restriction device responsive to an engine condition.

It is still yet another object of the present invention to provide an exhaust restriction device that is useful as a warm-up device for an engine.

It is yet a further object of the present invention to provide an exhaust restriction device that makes use of bolt-on bypass system.

It is still a further object of the present invention to provide a method of operating an exhaust restriction device to warm up an engine.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative, exhaust restriction device for carrying out engine warm-up, comprising: a main valve provided in a main passage running through the device; a bypass valve provided in a bypass passage running through the device, said bypass passage being connected to the main passage at a connection point upstream of the main valve; means for biasing the bypass valve to block the upstream connection point between the main passage and the bypass passage; means for opening the bypass valve responsive to a level of exhaust back pressure applied to the opening means; and means for transferring exhaust back pressure from the main passage to a chamber included in the opening means.

Applicants have also developed an innovative method of operating an exhaust restriction device to carry out engine warm-up, the method comprising the steps of: providing an exhaust restriction device with a main valve and a bypass valve, said bypass valve including a bypass valve stopper and a bypass valve actuator; selectively biasing the bypass valve into a closed position; selectively closing the main valve; increasing exhaust back pressure in the exhaust restriction device as a result of closing the main valve; applying the exhaust back pressure to the bypass valve stopper and the bypass valve actuator; and opening the bypass valve responsive to the level of exhaust back pressure applied to (1) the bypass valve stopper and (2) the bypass valve actuator.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 1:
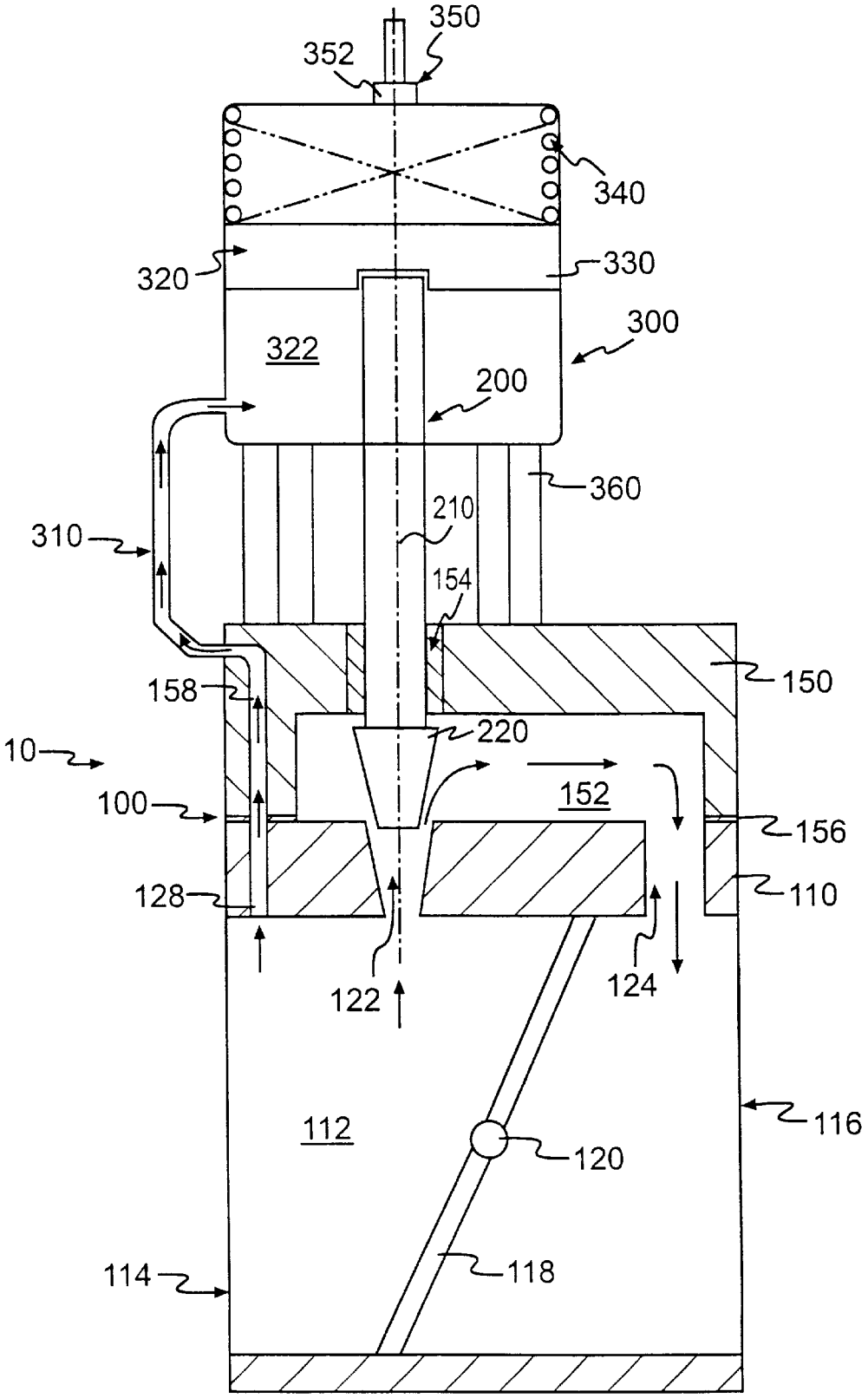
FIG. 1 is a cross-sectional view in elevation of an exhaust restriction device embodiment of the invention.

Reference will now be made in detail to a preferred embodiment of the present invention, an example of which is illustrated in the accompanying drawings. A preferred embodiment of the present invention is shown in FIG. 1 as exhaust restriction device 10.

In a preferred embodiment, the exhaust restriction device 10 comprises a main housing 100, a bypass valve 200, and an actuator 300. The main housing 100 may be further broken down into a primary exhaust housing 110 and a bypass exhaust housing 150, although the primary and bypass exhaust housings may be integrally formed in some instances. Both the primary and bypass exhaust housings may be cast and machined metal housings in a preferred embodiment of the invention. In a preferred embodiment of the invention, the bypass exhaust housing 150 may be bolted on the primary exhaust housing 110.

The primary exhaust housing 110 may have a main passage 112 extending therethrough, and an upstream inlet 114 and a downstream outlet 116. The inlet 114 may be connected to an upstream exhaust conduit (not shown) leading from an engine exhaust manifold or turbocharger outlet. Alternatively, the inlet 114 may be directly connected to a turbocharger outlet, or in a further alternative, the primary exhaust housing 110 may be integral with a turbocharger housing. The outlet 116 may be connected to the remainder of a vehicle exhaust system, which may include a muffler and exhaust pipe, and/or a turbocharger (not shown).

The primary exhaust housing 110 also includes a main exhaust valve, or gate 118 which may be used to selectively block and unblock the passage 112. The gate 118 is shown to be a butterfly valve in FIG. 1. The gate 118 may have an axle 120 running through a central region of the gate. The axle 120 may extend from the gate 118 through the primary exhaust housing 110 to an actuator (not shown) for the gate outside of the primary exhaust housing. The gate actuator may comprise a solenoid, air, vacuum, hydraulic, electronic, or other type of actuation device. The gate actuator may be operably linked to the gate 118 so that it can rotate the gate in the passage 112 between blocking and unblocking positions. In alternative embodiments, the gate 118 may be provided by a sliding gate, flapper, iris type, rotary, or any other means for selectively blocking the flow of exhaust gas through the passage 112.

In the preferred embodiment, when the gate 118 is in a blocking position, exhaust gas back pressure is increased on the upstream inlet 114 side of the main passage 112. When the gate 118 is in an unblocking position, the restriction imposed on the flow of exhaust gas through the main passage is minimized. The gate 118 may also be capable of holding a position intermediate of the blocking and unblocking positions to provide a predetermined level of exhaust restriction.

The bypass exhaust housing 150 may have a bypass passage 152 extending therethrough, which is adapted to permit the flow of exhaust gas through the bypass exhaust housing. The bypass exhaust housing 150 may also include a bore through the wall of the housing in which a bushing 154 is provided. The bushing 154 may provide a sealing arrangement between the bypass exhaust housing 150 and a bypass valve rod 210 that extends through the bushing 154.

The bypass exhaust housing 150 may be bolted, screwed, or welded onto the primary exhaust housing 110. Alternatively, the bypass exhaust housing 150 may be integrally cast with the main housing. Means for sealing 156 (such as a gasket) the bypass exhaust housing 150 to the primary exhaust housing 110 may be provided between the two housings. The sealing means 156 may be adapted to seal the two housings together to withstand the elevated exhaust temperatures and pressures of at least 80 psi that may occur within the housings during engine retarding, and of at least 30 psi during engine warm up The primary exhaust housing 110 may have two ports 122 and 124 formed in the wall of the housing 110 at upstream and downstream locations, respectively, relative to the gate 118. The ports 122 and 124 provide communication between the main passage 112 and the bypass passage 152. In a preferred embodiment of the invention, the upstream port 122 may be frusto-conically shaped to provide a valve seat adapted to receive a mating frusto-conical stopper 220, discussed below.

The primary exhaust housing 110 and the bypass exhaust housing 150 also may each include integrally formed exhaust pressure passages, 128 and 158, respectively. The exhaust pressure passages may communicate with each other such that exhaust gas pressure is transmitted from the upstream side of the main passage 112, through the exhaust pressure passages 128 and 158, to an exhaust pressure tube 310. The exhaust pressure tube 310 may be connected to the actuator 300, so that the upstream exhaust pressure in main passage 112 is ultimately transmitted to a chamber in the interior of actuator 300.

The bypass valve 200 includes a bypass valve stopper 220 connected to a rod 210. The connection of the stopper 220 to the rod 210 may be accomplished using a fastener such as a screw, weld, or rivet. The bypass valve stopper 220 may have a frusto-conical shape in a preferred embodiment of the invention. The conical shape of the stopper 220 may make it less likely that the stopper will jam against the mating valve seat formed by the wall of upstream port 122. The bypass stopper 220 is preferably provided such that it selectively blocks and unblocks the upstream port 122. The bypass stopper 220 is designed such that exhaust gas pressure applied from the main passage 112 on the stopper tends to assist in opening the bypass valve.

The rod 210 connects the stopper 220 with the actuator 300. The rod 210 may be slidable through the bushing 154, while at the same time being sufficiently sealed against the bushing to prevent exhaust gas from escaping past the bushing 154. The rod 210 and the stopper 220, preferably, may be made of stainless steel.

The actuator 300 may be used to provide an opening force for the bypass valve 200. The actuator 300 may include the exhaust pressure tube 310, an actuator housing 320, a piston 330, a spring 340, a bypass pressure adjuster 350, and an actuator mount 360. The actuator housing 320 may be connected to the main housing 100 by the mount 360. The mount 360 may provide sufficient separation of the actuator housing 320 from the main housing 100 as to provide some thermal isolation of the actuator housing and components contained therein. The mount 360 may include open interior spaces through which cooling air may flow. The thermal isolation of the actuator housing 320 from the main housing 100 may enhance the consistent operation of the spring 340 within the actuator housing. The mount may be connected to the actuator housing 320 and the main housing 100 by a bolt, weld, rivet, or equivalent.

The actuator housing 320 may contain a piston 330 sealed with a rolling diaphragm, and a spring 340 within the interior of the actuator housing. The interior of the actuator housing 320 is effectively divided by the piston 330 such that the spring 340 is on one side of the piston, and a hollow space or chamber 322 is on the other side of the piston. The piston 330, rod 210, and stopper 220, may be connected together such that they may slide up and down as a unit. The spring 340 may bias the piston 330, the rod 210 and the stopper 220 combination downward, causing the stopper 220 to seat in the upstream port 122. The spring 340 may have a length sufficient to remove the spring from excessive thermal loading which could effect the biasing force provided by the spring. The spring 340 may be selected to provide a relatively constant force on the piston 330 throughout the operational travel of the spring.

When the exhaust restriction device 10 is activated, the gate 118 may be rotated into a blocking position, as shown in FIG. 1. Exhaust gas flows into the upstream side of the main passage 112 through inlet 114 and is blocked by the gate 118. The blocked exhaust gas creates back pressure within the upstream side of the device 10.

The opening and closing of the bypass valve 200 may be mechanically/pneumatically controlled responsive to the level of exhaust back pressure on the upstream side of the main passage 112. This back pressure is applied to the stopper 220, and flows through passages 128, 158, and 310 into a chamber 322, where it is applied to the piston 330. The piston 330 is slidable within the actuator housing 320 and sealed to the wall of the actuator housing so that the exhaust back pressure does not substantially leak from the rod side of the piston 330 to the spring side of the piston.

Because the piston 330 slides within the actuator housing 320, the chamber 322 is variable in volume, depending upon the position of the piston 330 in the actuator housing. When the back pressure reaches a predetermined limited within the chamber 322 (e.g. 30 psi), determined by the biasing force of the spring 340, the pressure under the piston 330, alone or in combination with the pressure on the stopper 220, overcomes the biasing force of the spring 340 and the piston is displaced upward. As the piston 330 slides upward, it carries the rod 210 and the stopper 220 with it, such that the upstream port 122 is opened. Opening the upstream port 122 tends to relieve the back pressure on the upstream side of the main passage 112 by allowing exhaust gas to be diverted through the bypass passage 152 and out of the downstream port 124 to the downstream side of the main passage 112. As exhaust gas flows to the downstream side of the main passage 112, the exhaust back pressure asserted against the stopper 220 and the piston 330 falls until the downward biasing force of the spring 340 is sufficient to overcome the exhaust back pressure and re-seat the stopper 220 in the upstream port 122.

The biasing force applied by the spring 340 to the stopper 220 may be adjusted to control the exhaust back pressure level at which the stopper will be opened. The biasing force may equal the maximum exhaust back pressure the engine valve train can accommodate. The biasing force may changed by adjusting the position of a nut 352. Tightening of the nut 352 may further compress the spring 340 and increase the effective downward biasing force of the spring. Conversely, loosening of the nut 352 may decrease the effective biasing force of the spring 340. A control system (not shown) may be provided to adjust the nut 352 during vehicle operation.

In an alternative embodiment of the invention, a system for applying air pressure or vacuum may be substituted for, or assist, the spring 340 as a means for biasing the stopper 220.

A computer may be used to determine when the gate 118 should be opened based upon information received from sensors. The sensors may be used to sense conditions of the engine/vehicle, such as engine speed, exhaust gas pressure, engine temperature, exhaust gas temperature, exhaust gas recirculation activation, exhaust restriction device activation, foundation restriction device application, compression release braking activation, vehicle speed, cylinder pressure, intake manifold pressure, fuel rate, throttle position, percent of engine load, ambient temperature, air fuel ratio, vehicle start up time, engine coolant temperature, engine running time, and head rejection to coolant Btu/min.

Figure 2:
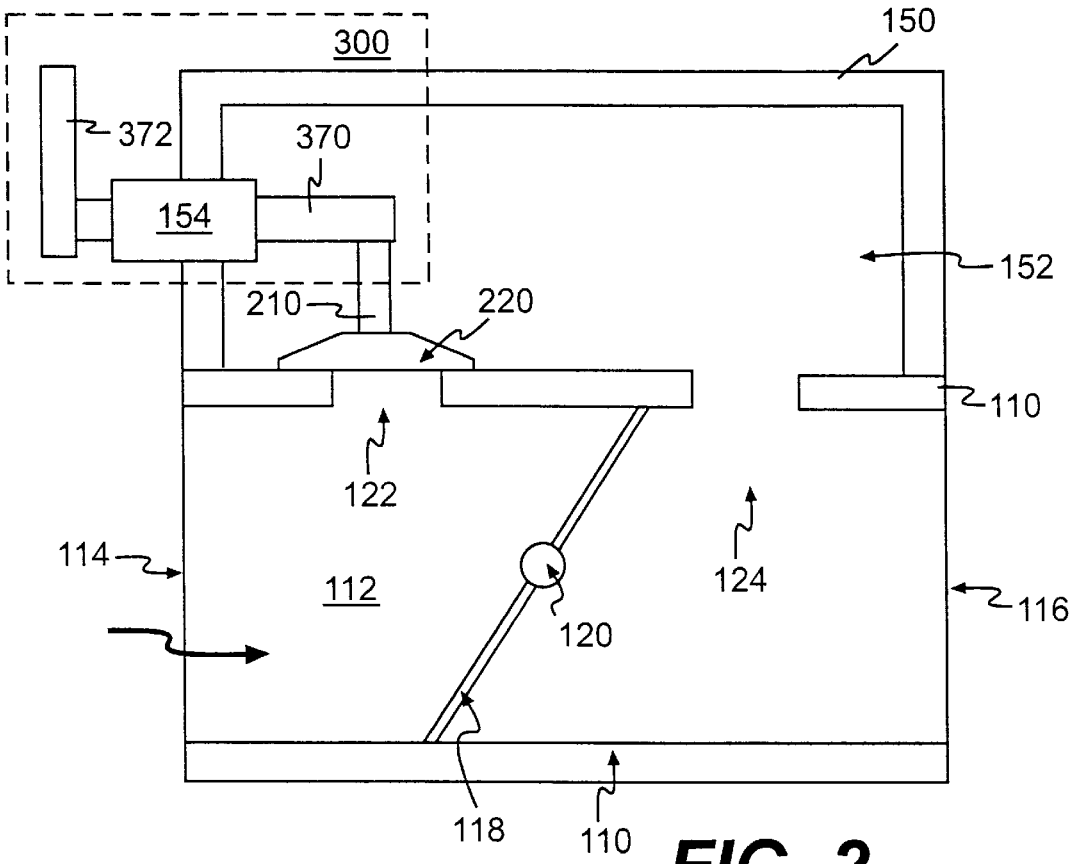
FIG. 2 is a cross-sectional view in elevation of a second exhaust restriction device embodiment of the invention.
Figure 3:
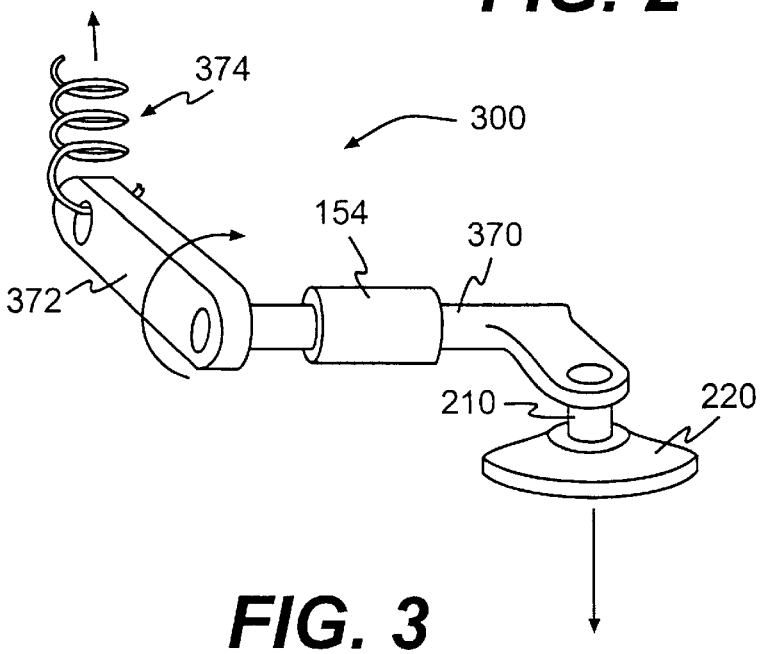
FIG. 3 is a pictorial view of the actuator shown in the exhaust restriction device of FIG. 2.

With regard to FIG. 2, in which like elements are identified with like reference numerals, in an alternative embodiment of the invention the biasing force on the stopper 220 is applied by an actuator 300 in the form of a biased pivoting arm. FIG. 3 is a pictorial view of the actuator 300, rod 210, and stopper 220 shown in FIG. 2. Although it is shown differently in FIG. 2, the stopper 220 may be conically shaped as shown in FIG. 1. With reference to FIGS. 2 and 3, the stopper 220 is biased downward over the upstream port 122 under the influence of the spring 374. The spring 374 is under tension, and accordingly, tends to rotate or bias the arm 372 clockwise. The clockwise rotation or bias of the arm 372 is transferred through an L-shaped member 370 to the rod 210. The clockwise rotation or bias of the L-shaped member displaces or biases the rod 210 downward, which in turn, displaces or biases the stopper 220 downward over the port 122.

The L-shaped member 370 may pass through a bushing 154, which allows the L-shaped member 370 to rotate within the bushing while maintaining a gas tight seal between the L-shaped member and the bushing. In such a manner, the bushing 154 may be used to prevent the exhaust gas within the bypass housing 150 from escaping, while at the same time allowing the biasing means for the actuator 300 to be located outside of the bypass housing, away from potentially harmful exhaust contaminants and temperature extremes.

The spring 374 may be provided with an appropriate tension, such that the downward biasing force on the stopper 220 is overcome by a predetermined level of exhaust back pressure applied through port 122. For example, the downward biasing force on the stopper 220 may be in the range of 30 psi. When the exhaust back pressure in the main passage 112 exceeds 30 psi, the stopper 220 may be forced upwards and exhaust gas in the main passage 112 will flow through the bypass passage 152. As a result of the diversion of exhaust gas through the bypass passage 152, the exhaust back pressure in the main passage 112 may fall below 30 psi and the stopper 220 will re-seat over the port 122.

Figure 4:
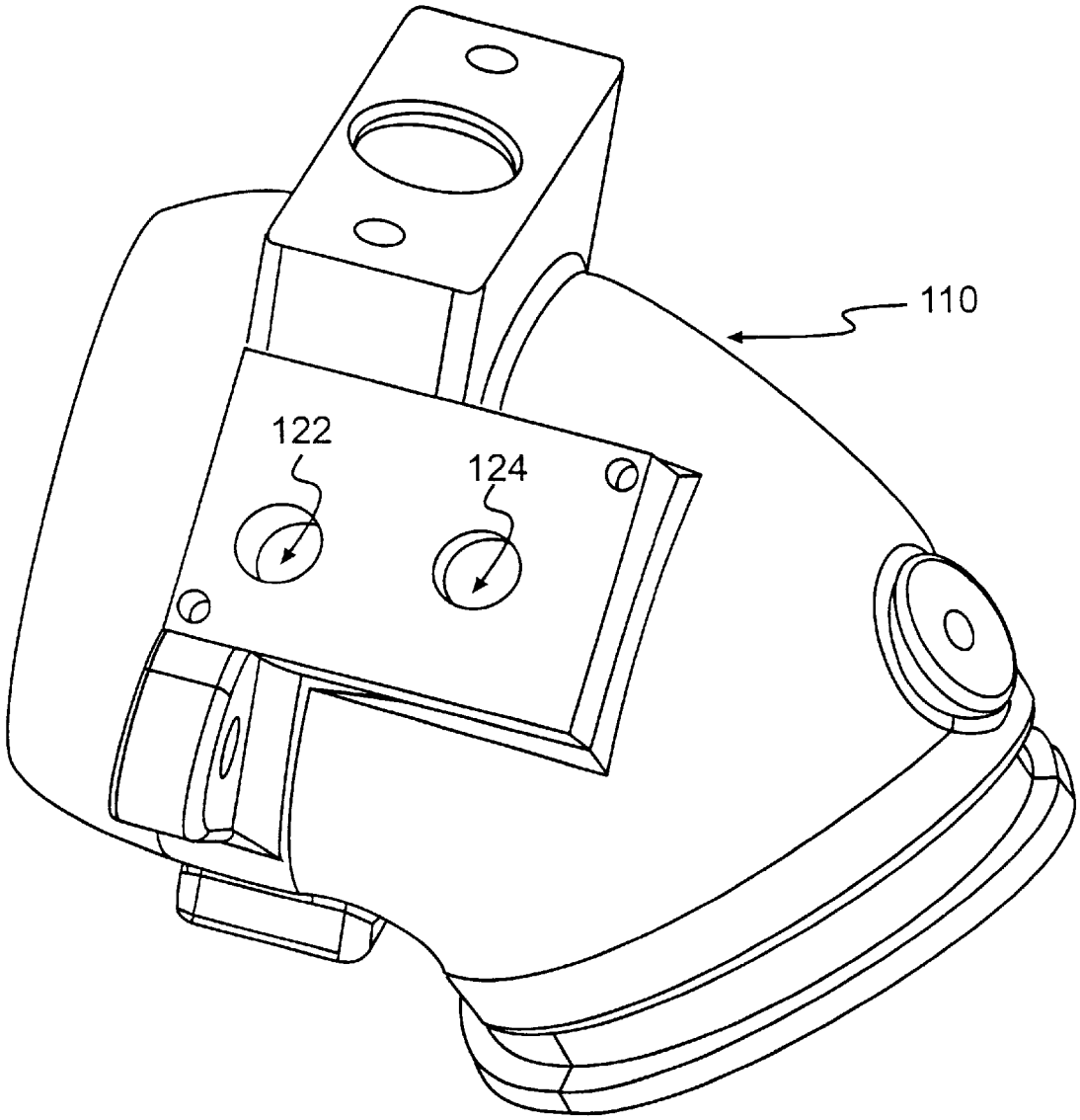
FIG. 4 is a pictorial view of a main exhaust housing onto which a bypass system may be bolted.

FIG. 4 is a pictorial view of one embodiment of the primary exhaust housing 110 that illustrates the incorporation of the upstream port 122 and the downstream port 124 into the housing.

It will be apparent to those skilled in the art that various modifications and variations can be made in the construction, configuration, and/or operation of the present invention without departing from the scope or spirit of the invention. For example, in the embodiments mentioned above, means other than a spring, such as hydraulic, electronic, air, vacuum, etc., may be used to bias the bypass valve stopper into a closed position, without departing from the scope of the invention. Further, various changes may be made to the shape of the main and bypass housing(s), and to the type of gate used to block the main passage, without departing from the scope of the invention. The invention also should not be limited to application in aftermarket exhaust restriction devices. Thus, it is intended that the present invention cover the modifications and variations of the invention provided they come within the scope of the appended claims and their equivalents.

We claim:

1. An exhaust restriction device located downstream of an exhaust manifold in an internal combustion engine, comprising:

a main housing having a main passage and a bypass passage therein;

a main exhaust valve for selectively blocking the flow of exhaust gas through the main passage;

an upstream port providing communication between the main passage and the bypass passage at a point upstream of the main exhaust valve;

a downstream port providing communication between the main passage and the bypass passage at a point downstream of the main exhaust valve;

a bypass valve stopper for selectively blocking the upstream port;

means for biasing the bypass valve stopper to block the upstream port; and means for opening the bypass valve stopper responsive to exhaust gas pressure in the device at a location upstream of the main exhaust valve.

2. The exhaust restriction device of claim 1 wherein said means for biasing comprises a spring.

3. The exhaust restriction device of claim 1 wherein said means for opening comprises:

a rod having first and second ends, said first end being connected to the bypass valve stopper and said second end extending out of the main housing;

an actuator housing connected to the main housing and having an opening therein for receiving the second end of the rod;

a piston connected to the second end of the rod, said piston being slidably disposed within the actuator housing between the rod and the biasing means such that a rod side and a biasing means side of the actuator housing are defined by said piston; and an exhaust pressure tube providing communication between an upstream side of the main passage and the rod side of the actuator housing.

4. The exhaust restriction device of claim 3 wherein the actuator housing is thermally isolated from the main housing.

5. The exhaust restriction device of claim 1 wherein the main exhaust valve selectively blocks the flow of exhaust gas through the main passage responsive to the engine fueling rate, engine speed, engine coolant temperature, vehicle speed, and engine running time.

6. The exhaust restriction device of claim 1 wherein the main exhaust valve selectively blocks the flow of exhaust gas through the main passage responsive to an engine condition selected from the group consisting of engine fueling rate, engine speed, engine coolant temperature, vehicle speed, and engine running time.

7. An exhaust restriction device for providing a substantially constant level of back pressure in an engine exhaust system, comprising:

a main housing having a main passage and a bypass passage therein;

a main exhaust valve for selectively blocking the flow of exhaust gas through the main passage;

an upstream port providing communication between the main passage and the bypass passage at a point upstream of the main exhaust valve;

a downstream port providing communication between the main passage and the bypass passage at a point downstream of the main exhaust valve;

a bypass valve stopper for selectively blocking the upstream port;

a rod having first and second ends, said first end being connected to the bypass valve stopper and said second end extending out of the main housing;

an actuator housing connected to the main housing and having an opening therein for receiving the second end of the rod;

a spring biased piston located within the actuator housing, said piston being connected to and biased towards the second end of the rod such that the bypass valve stopper is biased into the upstream port from the direction of the bypass passage; and an exhaust pressure tube providing communication between an upstream side of the main passage and the actuator housing, wherein the bypass valve stopper is adapted to be pulled out of the upstream port responsive to the displacement of the piston in the actuator housing due to the transmission of exhaust gas pressure from the upstream side of the main passage to the actuator housing.

8. In an exhaust restriction device comprising a main housing containing a main exhaust passage, a main valve, a bypass passage, and a bypass valve for closing the bypass passage, the improvement comprising means for selectively opening the bypass valve responsive to the application of exhaust gas pressure to an actuator that is thermally isolated from the main exhaust housing.

9. An exhaust restriction device for carrying out engine warm-up, comprising:

a main valve provided in a main passage running through the device;

a bypass valve provided in a bypass passage running through the device, said bypass passage being connected to the main passage at a connection point upstream of the main valve;

means for biasing the bypass valve to block the upstream connection point between the main passage and the bypass passage;

means for opening the bypass valve responsive to a level of exhaust back pressure applied to the opening means; and means for transferring exhaust back pressure from the main passage to a chamber included in the opening means.

10. A method of operating an exhaust restriction device to carry out engine warm-up, the method comprising the steps of:

providing an exhaust restriction device with a main valve and a bypass valve, said bypass valve including a bypass valve stopper and a bypass valve actuator;

selectively biasing the bypass valve into a closed position;

selectively closing the main valve;

increasing exhaust back pressure in the exhaust restriction device as a result of closing the main valve;

applying the exhaust back pressure to the bypass valve stopper and the bypass valve actuator; and opening the bypass valve responsive to the level of exhaust back pressure applied to the bypass valve stopper and the bypass valve actuator.

11. The exhaust restriction device of claim 1 further comprising a second upstream port for providing communications between the main passage and the opening means.

12. The exhaust restriction device of claim 11 wherein said means for biasing comprises a spring.

13. The exhaust restriction device of claim 12 wherein said means for opening comprises:

a rod having first and second ends, said first end being connected to the bypass valve stopper and said second end extending out of the main housing.

14. The exhaust restriction device of claim 13 wherein said means for opening further comprises:

an actuator housing connected to the main housing and having an opening therein for receiving the second end of the rod;

a piston connected to the second end of the rod, said piston being slidably disposed within the actuator housing between the rod and the biasing means such that a rod side and a biasing means side of the actuator housing are defined by said piston; and an exhaust pressure tube providing communication between an upstream side of the main passage and the rod side of the actuator housing.

15. The exhaust restriction device of claim 14 wherein the actuator housing is thermally isolated from the main housing.

16. The exhaust restriction device of claim 15 wherein the main exhaust valve selectively blocks the flow of exhaust gas through the main passage responsive to the engine fueling rate, engine speed, engine coolant temperature, vehicle speed, and engine running time.

17. The exhaust restriction device of claim 15 wherein the main exhaust valve selectively blocks the flow of exhaust gas through the main passage responsive to an engine condition selected from the group consisting of engine fueling rate, engine speed, engine coolant temperature, vehicle speed, and engine running time.

* * * * *